United States Patent [19]

Wallis

[11] 4,066,139

[45] Jan. 3, 1978

[54] SAMPLING DRILL

[76] Inventor: Jamie Malcolm Wallis, 54 Beaconsfield Avenue, Midvale, Western Australia, 6056, Australia

[21] Appl. No.: 579,802

[22] Filed: May 22, 1975

[30] Foreign Application Priority Data

May 28, 1974 Australia ..... 7685/74
Dec. 19, 1974 Australia ..... 76654/74

[51] Int. Cl.[2] ..... E21C 13/02; E21B 41/00; E21B 49/02

[52] U.S. Cl. ..... 175/232; 175/321; 175/58

[58] Field of Search ..... 175/58, 59, 232–235, 175/321, 320

[56] References Cited

U.S. PATENT DOCUMENTS

| | | | |
|---|---|---|---|
| 2,248,910 | 7/1941 | Auld et al. | 175/233 |
| 2,412,915 | 12/1946 | Sewell | 175/233 |
| 2,894,727 | 7/1959 | Henderson | 175/321 X |
| 3,062,045 | 11/1962 | Sökjer-Petersen et al. | 175/58 X |
| 3,146,837 | 9/1964 | Bridwell | 175/59 |
| 3,151,690 | 10/1964 | Grable | 175/321 |
| 3,323,604 | 6/1967 | Henderson | 175/58 X |

*Primary Examiner*—Stephen J. Novosad
*Attorney, Agent, or Firm*—Haseltine, Lake & Waters

[57] ABSTRACT

A sampling drill comprising a plurality of drill rods coupled together to form a drill stem suspended from a drill head, each of the drill rods comprising a pair of substantially concentric tubular members defining an inner central passage and an annular passage, the lower end of the drill stem being fitted with a drill bit having an inner chamber adapted to be connected to the inner central passage of the drill stem, and one or more passages adapted to be connected at one end to the annular passage in the drill stem and at the other end to discharge into the inner chamber, the inner chamber being provided with openings located adjacent the cutting edges of the drill bit so that material cut by the drill bit can pass into the chamber, and means for shutting off the inner central passage to prevent material entering the inner chamber of the drill bit and entering the inner central passage.

1 Claim, 2 Drawing Figures

SAMPLING DRILL

This invention relates to a sampling drill for obtaining samples for geological testing and exploration. The sampling drill of the present invention is particularly suitable for use in drilling through sand and other relatively soft material and in situations where water may be encountered.

In one form the invention resides in a sampling drill comprising a plurality of drill rods coupled together to form a drill stem suspended from a drill head, each of the drill rods comprising a pair of substantially concentric tubular members defining an inner central passage and an annular passage, the lower end of the drill stem being fitted with a drill bit having an inner chamber adapted to be connected to the inner central passage of the drill stem, and one or more passages adapted to be connected at one end to the annular passage in the drill stem and at the other end to discharge into the inner chamber. The latter is provided with openings located adjacent the cutting edges of the drill bit so that material cut by the drill bit can pass into the chamber, having means for shutting off the inner central passage to prevent material entering the inner chamber of the drill bit and entering the inner central passage.

The invention will be better understood by reference to the following description of one specific embodiment shown in the accompanying drawings wherein:-

Figure 1:
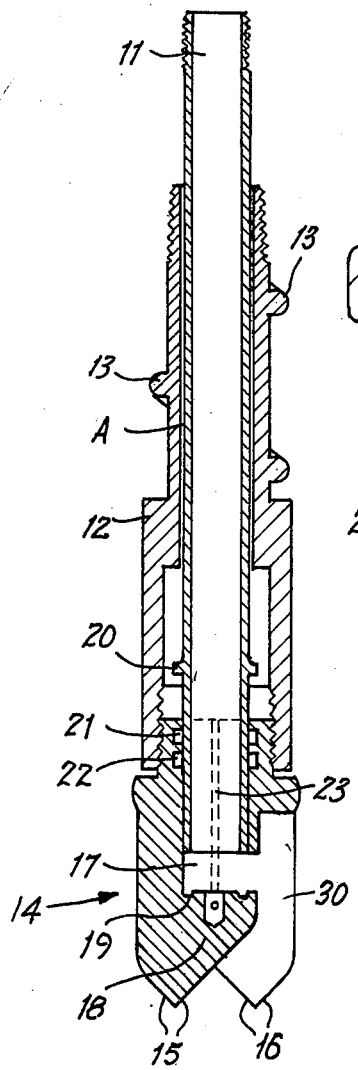
Figure 2:
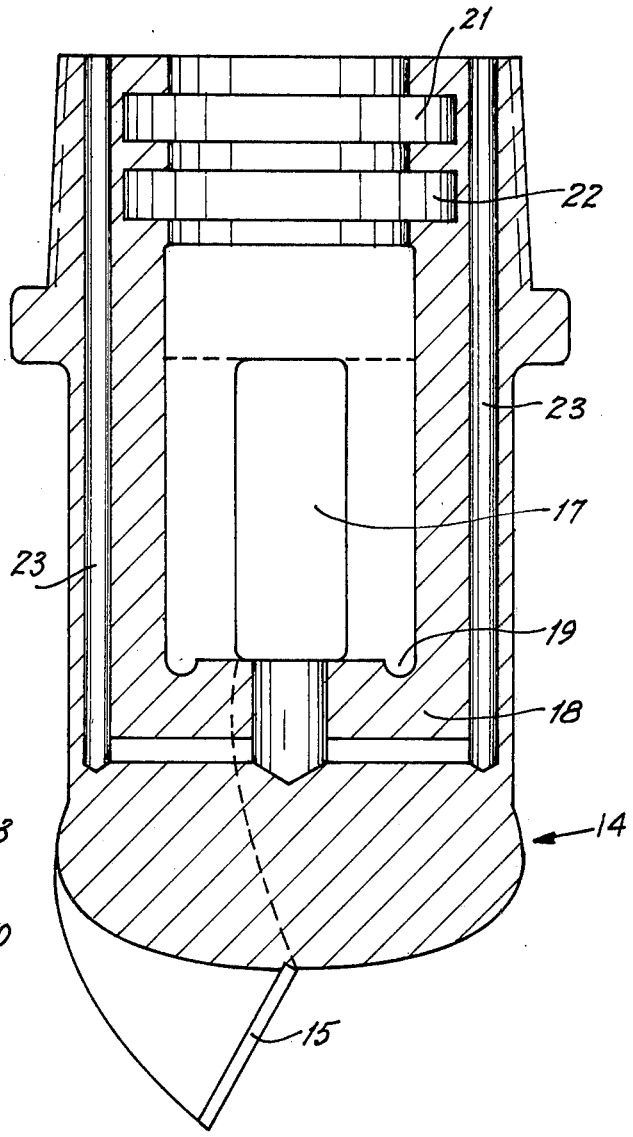

FIG. 1 is a sectional elevation of a drilling bit suitable for obtaining core samples from mineral sands; and FIG. 2 is an enlarged sectional elevation of the cutting component of the drill or drill bit, the section being taken at 90° to that of FIG. 1; and In this embodiment the drill rods (not shown) are formed from two lengths of tubular metal located concentrically one inside the other to provide a central circular inner passage and an annular or outer passage. One end of each of the two components of each drill rod is provided with an externally tapered thread adapted to engage a correspondingly tapered socket in the adjacent end of each of the two components of an adjacent drill rod.

A drill stem is formed from an assembly of the drill rods, the lower end of the stem being fitted with a drill bit and the upper end of the stem fitted into a drill head in the usual manner. The outer face of each drill rod is fitted with auger flights in the usual manner while the upper end of the inner portion of the stem is fitted with a suitable controlling device. The head is also provided with means for feeding air under pressure into the annular passage between the inner and outer portions of the drill stem.

As shown in the drawing the drill unit comprises an inner tubular member 11 adapted to be coupled to the inner central passage of the drill stem and an outer tubular member 12 adapted to be coupled to the outer component of the drill stem. The outer surface of the outer tubular member 12 is provided with auger flights 13 which mate with auger flights on an outer component of the drill stem. An drill bit 14 which is provided with cutting edges 15 and 16 is screwed into the lower end of the outer tubular member 12 so as to be contiguous therewith.

The bit is provided with an inner chamber 17 which is connected to the exterior of the bit through vertical openings 30 adjacent the cutting edges 16. The lower portion of the chamber 17 has a central boss 18. The inner tubular member 11 is slidably mounted within the outer tubular member and in the lowermost position as shown in the drawing the lower end thereof passes through the chamber 17 and rests in a recess 19 formed in the upper face of the central boss 18 of the bit.

The inner tubular member 11 is provided with an outwardly projecting flange 20 which limits the upward movement of the inner tubular member 12 with respect to the outer tubular member. The neck of the drill bit through which the inner tubular member passes is provided with recesses 21 and 22 into which sealing members (not shown) are fitted. The body of the drill bit is provided with a series of substantially L-shaped passages 23 which discharge through the central boss 18 in the chamber 17 between the boss 18 and the cutting edges 16 of the bit.

In the position shown in FIG. 1 of the drawing with the lower end of the inner tubular member 11 partly raised above the central boss 18, the air passing down the annular space in the drill stem passes through the annular space A between the inner and outer tubular members 11 and 12 and is discharged through the passages 23 into the chamber 17 in the drill bit.

When drilling is proceeding the cuttings enter the chamber 17 and are carried upwardly through the inner tubular member 11 into the central passage of the drill stem and to the surface by the stream of air and provide a true sample of the section being drilled.

When drilling stops the inner tubular member 11 is lowered to seat on the boss 18 by the action of the controlling device, the inner central passage is shut off and any water or loose material in the bottom of the hole is excluded.

Although the invention has been described with particular reference to one particular form of bit any other suitable type of bit may be used.

I claim:

1. A sampling drill comprising a plurality of drill rods coupled together to form a drill stem suspended from a drill head; said rods including each a pair of substantially concentric tubular members defining an inner central passage and an annular passage; the lower end of said stem being fitted with a drill bit including a neck, cutting edges and means defining an inner chamber means in said bit, said chamber means being connectable to said central passage, and means defining at least one passage in said bit, connected in fluid communication at one end of said annular passage and at the other end to discharge into said chamber means; said chamber means being provided with openings located adjacent said edges so that material cut by said bit can pass into said chamber means; wherein the lower end of an inner member of said drill stem is connected to a tubular member, the lower end of which latter slidably passes through said neck in sealing engagement therewith to seat on a central boss within said chamber means, to constitute means for shutting off said central passage to prevent the material from entering said chamber means and entering said central passage.

* * * * *